US008522389B2

(12) United States Patent
Kwon et al.

(10) Patent No.: US 8,522,389 B2
(45) Date of Patent: Sep. 3, 2013

(54) MANUFACTURING METHOD OF NEEDLE-SHAPED BRISTLES HAVING SHORT TAPER LENGTH AND A TOOTHBRUSH BY SAME MANUFACTURING METHOD

(75) Inventors: Young-Jun Kwon, Gyunggi-do (KR); Sung-Wook Kwon, Seoul (KR); Sung-Hwan Kwon, Seoul (KR)

(73) Assignee: Best Whasung Co., Ltd., Paju, Gyunngi-Do (KR)

( * ) Notice: Subject to any disclaimer, the term of this patent is extended or adjusted under 35 U.S.C. 154(b) by 336 days.

(21) Appl. No.: 12/443,120

(22) PCT Filed: Nov. 29, 2006

(86) PCT No.: PCT/KR2006/005098

§ 371 (c)(1), (2), (4) Date: Apr. 16, 2009

(87) PCT Pub. No.: WO2008/060005

PCT Pub. Date: May 22, 2008

(65) Prior Publication Data

US 2010/0115725 A1 May 13, 2010

(30) Foreign Application Priority Data

Nov. 16, 2006 (KR) ..... 10-2006-0113114

(51) Int. Cl.
*A46D 1/05* (2006.01)

(52) U.S. Cl.
USPC ..... 15/207.2; 15/167.1

(58) Field of Classification Search
USPC ..... 300/21; 15/167.1, 207.2; 8/492, 8/497, 114.6, 115.7, 115.54; 264/341; 51/297; 428/374, 364
See application file for complete search history.

(56) References Cited

U.S. PATENT DOCUMENTS

| | | | | | |
|---|---|---|---|---|---|
| 2,055,321 | A | * | 9/1936 | Kedzie | 427/384 |
| 2,109,579 | A | * | 3/1938 | Talbot | 15/207.2 |
| 2,123,502 | A | * | 7/1938 | Cupery | 428/393 |
| 2,309,021 | A | * | 1/1943 | Stonehill | 15/159.1 |
| 3,076,218 | A | * | 2/1963 | Cook et al. | 15/207.2 |

(Continued)

FOREIGN PATENT DOCUMENTS

| | | |
|---|---|---|
| JP | Sho 57-12934 | 1/1982 |
| JP | Sho 61-10495 | 4/1986 |

(Continued)

OTHER PUBLICATIONS

"Tape." YourDictionary. 2011. http://www.yourdictionary.com (Sep. 6, 2011).*

*Primary Examiner* — Joseph J Hail
*Assistant Examiner* — Joel Crandall
(74) *Attorney, Agent, or Firm* — Egbert Law Offices, PLLC

(57) ABSTRACT

The present invention relates to a method of manufacturing a needle-shaped bristle having a short taper length. The method includes preparing a bundle of toothbrush bristles by mixing a polyester resin (a polyester resin other than a PTT resin) and a PTT resin in a ratio of 90~40 to 10~60 and spinning the mixture thereof; cutting the bundle of toothbrush bristles; and tapering the cut bundle of toothbrush bristles by immersing it into a chemical. According to the present invention, since needle-shaped bristles having a taper length of 6 mm or less can be efficiently obtained, the needle-shaped bristles can be implanted even in an anchorless toothbrush.

2 Claims, 2 Drawing Sheets

(56) References Cited

U.S. PATENT DOCUMENTS

| | | | | | |
|---|---|---|---|---|---|
| 3,162,572 | A | * | 12/1964 | Lee Granquist et al. | 424/658 |
| 3,422,180 | A | * | 1/1969 | Boyer Nolan D et al. | 264/341 |
| 3,620,677 | A | * | 11/1971 | Ayers Morison | 422/423 |
| 3,830,547 | A | * | 8/1974 | Awazi et al. | 300/21 |
| 4,285,892 | A | * | 8/1981 | Betsuda et al. | 264/443 |
| 4,332,585 | A | * | 6/1982 | Minemura et al. | 8/114.6 |
| 4,475,330 | A | * | 10/1984 | Kimura et al. | 57/245 |
| 5,340,909 | A | * | 8/1994 | Doerr et al. | 528/276 |
| 5,500,975 | A | | 3/1996 | Sano | |
| 6,018,840 | A | * | 2/2000 | Guay et al. | 15/207.2 |
| 6,090,488 | A | * | 7/2000 | Kweon | 428/399 |
| 6,764,142 | B2 | * | 7/2004 | Kwon | 300/21 |
| 7,752,702 | B2 | * | 7/2010 | Nakamura et al. | 15/207.2 |
| 2002/0092109 | A1 | * | 7/2002 | Edwards et al. | 15/207.2 |
| 2005/0093196 | A1 | * | 5/2005 | Chang et al. | 264/172.14 |
| 2006/0088711 | A1 | * | 4/2006 | Nakamura et al. | 428/364 |

FOREIGN PATENT DOCUMENTS

| | | | |
|---|---|---|---|
| JP | 61252074 | A * | 11/1986 |
| JP | Hei 05-15834 | | 1/1993 |
| JP | 06-141923 | | 5/1994 |
| JP | 3022762 | | 12/1997 |
| JP | 2002-192023 | | 10/2002 |
| KR | 10-0130932 | | 4/1998 |
| KR | 261658 | | 7/2000 |
| KR | 0464634 | | 1/2005 |
| KR | 3073200 | | 1/2005 |
| WO | 2006/101286 | | 9/2006 |

* cited by examiner

MANUFACTURING METHOD OF NEEDLE-SHAPED BRISTLES HAVING SHORT TAPER LENGTH AND A TOOTHBRUSH BY SAME MANUFACTURING METHOD

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates to a method of manufacturing a needle-shaped bristle and a toothbrush manufactured using the same method, and, more particularly, to a method of manufacturing a needle-shaped bristle and a toothbrush manufactured using the same method, in which the needle-shaped bristle has a tip thickness of 0.01~0.04 mm and a taper length of 2.0~6.0 mm.

2. Description of Related Art Including Information Disclosed Under 37 CFR 1.97 and 37 CFR 1.98

A method of tapering a polyester toothbrush bristle uses a principle in which, when a polyester fiber is immersed into a heated sodium hydroxide solution, part of the fiber is dissolved. Toray Industries, Inc. disclosed, for the first time, a method of tapering a tip of a bristle, in which a bundle of polyester bristles is cut to a predetermined length, is vertically immersed in a sodium hydroxide solution, having a concentration of 20% and a temperature of 100 or more, to a depth of about 5 mm, and is then dissolved (hydrolyzed), based on this principle (Japanese Examined Utility Model Sho 50-40195).

Further, Korean Patent No. 10-0130932 disclosed a method of tapering a monofilament for a toothbrush, in which a bundle of toothbrush bristles is dissolved in sulfuric acid, having a concentration of 80~90% and a temperature of 80~200°, and is thus tapered.

Toray Filament Inc., which is a company affiliated with Toray Industries, Inc., disclosed a technology of manufacturing brushes by implanting bristles, each of which has a taper at one end thereof without folding, or bristles, each of which has tapers at both ends thereof and folded in half, using the above methods (Japanese Unexamined Utility Model Sho 57-12934), and disclosed a method of manufacturing a toothbrush by folding a bristle such that a tapered part of the bristle is relatively long whereas an untapered part of the bristle is relatively short (Japanese Examined Utility Model Sho 61-10495).

Moreover, Toray Filament Inc. disclosed a method of manufacturing a toothbrush by folding toothbrush bristles, each of which has tapers at both ends thereof, in half and implanting them in the head of a toothbrush (Japanese Unexamined Utility Model Hei 05-15834). This method has been widely used.

That is, there has been disclosed a technology of manufacturing a toothbrush by folding toothbrush bristles, each of which has tapers at both ends thereof, in half and implanting them in the head of a toothbrush. The toothbrush bristles are cut to a predetermined size, one end of the toothbrush bristle is dissolved by vertically immersing the tip of the toothbrush bristle into a chemical, and the other end of the toothbrush bristle is dissolved using the same method. The bristle is then cooled, neutralized, cleaned in water and dried, thereby manufacturing the double end tapered toothbrush bristle.

However, the above method has a problem in that a lot of time is required to perform the tapering process. For example, when the tapering process is performed using a sodium hydroxide solution having a concentration of 40% at a temperature of 110°, 80 minutes are required to perform the process of tapering one end of a toothbrush bristle.

In order to solve the problem, the present inventor has completed an invention, which is disclosed in Korean Patent Application No. 10-2006-0103321 (hereinafter, referred to as the "prior art"), relating to "a method of tapering a toothbrush bristle, in which a bundle of cut bristles is preliminarily immersed in a liquid material, and then the entire bundle of bristles is immersed in a chemical, whereby both ends of the bristle are tapered".

The efficiency of the tapering of the toothbrush bristle is increased about three times using this method. However, this method still has a problem in that the taper length of the toothbrush bristle is about 5~8 mm, which is similar to that obtained by conventional technologies, and is comparatively long.

In a method of implanting a bristle without using an anchor, which has been widely used in recent years, when the taper length of a toothbrush bristle is 6 mm or more, it is difficult to dissolve the toothbrush bristle because the length of the toothbrush bristle used in the method of implanting a bristle without using the anchor is about ½ of the length of a toothbrush bristle used in the method of implanting a bristle by fixing the bristle using an anchor, which is used in a conventional method. The length of a bundle of toothbrush bristles is short at the time of vertically tapering the bundle of the toothbrush bristle. In this method, it is also difficult to bind the toothbrush bristles using a rubber band after a process of cleaning in water and a drying process because the taper length is relatively long, and it is difficult to produce a toothbrush because the toothbrush bristle does not have desired mechanical properties. Accordingly, in the toothbrush manufactured using the method of implanting bristles without using an anchor, it is required that the taper length of the toothbrush bristle be 6 mm or less, preferably 5 mm or less, and more preferably 4 mm or less.

Meanwhile, after a chemical immersion process is performed, the toothbrush bristle may be processed such that the taper length thereof is 4 mm or less through a mechanical grinding process. However, there is a problem in that needle-shaped bristles formed through this method, as shown in FIG. 1, pierce the gums at the time of brushing the teeth because a taper angle of the needle-shaped bristles is gentle. Further, the needle-shaped bristles formed through this method have problems in that the thickness of the tip thereof is not uniform due to differences of surface contact pressures at the time of grinding, the tip thereof is easily bent, and this bent portion breaks at the time of brushing the teeth.

Further, in the technology for decreasing the taper length of a toothbrush bristle, there have been attempts to additionally use an organic quaternary ammonium salt decomposition promoter. However, there remain problems in that the decomposition promoter is expensive, the toothbrush bristle is yellowed, and the taper length is not shortened to the desired extent.

BRIEF SUMMARY OF THE INVENTION

Disclosure

Technical Problem

Accordingly, the present invention has been made to solve the above problems, and an object of the present invention is to provide a method of manufacturing needle-shaped bristles, in which the needle-shaped bristles have a uniform thickness at a tip thereof, and have a taper length of 6 mm or less.

Another object of the present invention is to provide a method of tapering a toothbrush bristle, which can reduce a tapering time to ⅓ of a time required for the conventional methods, and can be used to perform a tapering process in a small space.

A further object of the present invention is to provide a toothbrush, which can be obtained through only a chemical treatment process, without requiring a grinding process, and is provided with needle-shaped bristles implanted therein and having taper lengths of 6 mm or less.

Technical Solution

In order to accomplish the above objects, the present invention provides a method of manufacturing needle-shaped bristles having a short taper length, including the steps of preparing a bundle of toothbrush bristles by mixing a polyester resin (a polyester resin other than a PTT resin) and a PTT resin in a ratio of 90~40 to 10~60 by weight and spinning the mixture thereof; cutting the bundle of toothbrush bristles; and tapering the cut bundle of toothbrush bristles by immersing it into a chemical.

Advantageous Effects

As describe in Examples and Comparative Examples, according to the present invention, the production efficiency of needle-shaped bristles is increased approximately three times, and the loss of raw materials is greatly decreased because several processes are not performed.

Since the immersion process of the present invention is performed only one time, the production efficiency is doubled, compared to the conventional method, in which the immersion process is performed two times, the time required to manufacture a bundle of bristles is decreased, and the immersion time in the present invention, in which the entire bundle of bristles is immersed, is also decreased, compared to the conventional method, in which only one end of the bundle of bristles is immersed.

The reason is that, because the entire bundle of bristles is immersed into a chemical, a high temperature is maintained, compared to the conventional method, in which only the tip of the bundle of bristles is immersed.

Further, according to the present invention, since needle-shaped bristles having a taper length of 6 mm or less can be efficiently obtained, the needle-shaped bristle can be implanted even in an anchorless type toothbrush.

DETAILED DESCRIPTION OF THE INVENTION

Figure 1:
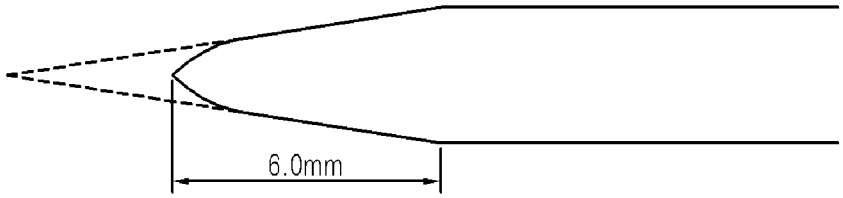
FIG. 1 is a side elevation view showing a needle-shaped bristle manufactured by immersing a toothbrush bristle in a chemical and then grinding the toothbrush bristle.

Hereinafter, the present invention will be described in detail.

In conventional chemical immersion methods, one end of a bundle of bristles is vertically immersed into a chemical, is maintained for a predetermined period of time to allow the chemical to infiltrate into the bundle of bristles by a capillary phenomenon, and is cleaned in water. Thereafter, the other end of the bundle of bristles is immersed into the chemical.

When the entire bundle of bristles is immersed into the chemical, the chemical infiltrates too deeply into the bundle of bristles, so that the taper length of the bristles is excessively increased and is not uniform, with the result that the thicknesses of the tips of the bristles are also not uniform. Accordingly, first, one end of the bundle of bristles must be immersed into the chemical and thus tapered, and then the other end thereof must be tapered.

In the prior art, the entire bundle of bristles is immersed into the chemical. Even though the entire bundle of bristles is immersed into the chemical, the capillary phenomenon must be suppressed to solve the above problems.

The term "capillary phenomenon" means a phenomenon in which liquid, which is adjacent to a narrow space, infiltrates into the space. When the bundle of bristles is immersed into a chemical, the chemical infiltrates into narrow spaces between the bristles bound in the bundle. After a sufficient time passes, the chemical has infiltrated into the innermost portions of the bundle. Since the bristle intensively decomposes at a region in which the temperature is maintained high, among the entire region into which the chemical infiltrates, the taper length is determined according to the sum of the length of the immersed region of the bristle and the length of the region in which the temperature is maintained relatively high.

In the prior art, in order to suppress the capillary phenomenon, an entire bundle of bristles is immersed into liquid such as water or a surfactant before it is immersed into a chemical.

A bundle of bristles primarily immersed in liquid such as water greatly prevents a chemical from infiltrating into spaces between the toothbrush bristles because the spaces are filled with water etc., and thus the capillary phenomenon is suppressed. Accordingly, even though the bundle of bristles, primarily infiltrated into liquid such as water, is immersed into the chemical, the problems in which the taper length of bristle is excessively increased are avoided.

Liquid such as water, used in a pretreatment process, decreases the taper length of bristles in proportion to the increase in temperature thereof within the range in which the liquid maintains a liquid phase. The reason is that the chemical more intensively decomposes the bristle at high temperatures, so that liquid at low temperatures decreases the temperature at which the chemical infiltrates into the center of the bundle of bristles, thereby decreasing the decomposition rate of the bristles.

Since the taper length of the bristles is different depending on the kind of liquid used in the preliminary immersion process, the taper length can be adjusted by selecting an appropriate liquid.

When liquid, such as water, having a high surface tension, is used in the preliminary immersion process, a relatively small amount of liquid infiltrates into the spaces of the bundle of bristles, so that the chemical easily infiltrates into the spaces in the bundle of bristles, thereby increasing the taper length of the bristles. In contrast, when liquid, such as alcohol or a surfactant, having a low surface tension, is used in the preliminary immersion process, the taper length of bristles is decreased, for the opposite reason.

In a conventional method, in which a bundle of bristles is vertically immersed into a chemical to a depth of about 5 mm, an apparatus for holding the bundle of bristles is additionally required. Furthermore, a relatively large place is also required because it is impossible for the bundles of bristles to be layered and immersed in the layered state. However, as described in the present invention, when the bundle of bristles is preliminarily immersed into the liquid and is then entirely immersed into the chemical, the apparatus for holding the bundle of bristles is not required, and it is possible to perform a process even in a small place because the plurality of bundles of bristles is layered at random and is entirely immersed into the chemical.

In another embodiment of the prior art, only one end of each bristle is tapered. A needle-shaped bristle, one end of which is tapered, is used in a method of implanting a bristle by fixing the bristle using an anchor, which is a conventional method, and a method of implanting a bristle without using the anchor. Among them, the method of implanting the bristle without using the anchor has been widely used in recent years because various patterns of implanted bristle groups can be formed using this method.

As described above, it is difficult to dissolve the toothbrush bristle because the length of the toothbrush bristle used in the method of implanting a bristle without using the anchor is about ½ of the length of the toothbrush bristle used in the method of implanting a bristle by fixing the bristle using an anchor, which is a conventional method, and thus the length of the bundle of toothbrush bristles is reduced at the time of vertically tapering the bundle of the toothbrush bristle, it is also difficult to bind the toothbrush bristles using a rubber band after a process of cleaning in water and a drying process because the taper length is relatively long, and it is difficult to produce a toothbrush because the toothbrush bristle does not have desired mechanical properties. Accordingly, in order to overcome the above problems, an inefficient method, in which the toothbrush bristle used in the conventional method of implanting a bristle by fixing the bristle using an anchor is implanted in a toothbrush through a fusion bonding method, and then the portion of the toothbrush bristle other than the portion thereof having a predetermined length is cut and discarded, must be used.

The above problems were almost overcome in the prior art.

When only one end of bristle is intended to be tapered, two bundles of bristles are layered, the layered portion is sealed using tape so that chemicals do not infiltrate into the layered portion, the sealed bundles of toothbrush bristles are preliminarily immersed in liquid, and then the bundles of toothbrush bristles are entirely immersed into a chemical, as in the conventional method of tapering both ends of bristle.

The conventional chemical treatment is performed two times. However, in a further embodiment of the prior art, the chemical treatment is performed once such that one end of the toothbrush bristle is tapered and the other sharp end thereof is only slightly dissolved. In order to improve a polishing and cleaning property, there is also an embodiment of the prior art, in which one end of the toothbrush bristle is tapered and the other end thereof is not tapered, but an sharp section formed at the time of the cutting process is polished round and then the toothbrush bristle is implanted in a toothbrush with it folded in half. Generally, although the sharp section of the toothbrush bristle is polished round through mechanical polishing methods, the sharp edges of the bristles may be dissolved by performing a chemical immersion process once.

In the prior art, in a method of manufacturing a needle-shaped bristle, one end of which is tapered, by layering two bundles of bristles and sealing them using sealing tape, only a small amount of chemical infiltrates into the bundles of bristles by forming small holes in the sealing tape, so that the tips of the bristles, which are not to be tapered, are partially dissolved, thereby dissolving the sharp edges of the bristles formed at the time of cutting. Similar to the method of forming the small holes in the sealing tape, the two bundles of bristles may be layered without sealing them using the tape, and may be bound using a rubber band, and then may pass through a chemical immersion process.

As described above, a taper length of a needle-shaped bristle obtained through the prior art is in the range of 5~8 mm. When the taper length is 6 mm or more, it is difficult to apply the needle-shaped bristles to an anchorless type toothbrush.

In the present invention, a material prepared by mixing a polyester resin and a PTT (Polytrimethylene terephtalate) resin and spinning the mixture thereof is used as a base material of toothbrush bristles, thereby overcoming the above problems in the prior art.

Generally, the term "polyester resin" means a polymer having an ester bond —CO—O— in a main chain thereof". Polyester resins such as PET and PBT are mainly used as a base material of toothbrush bristle. In the present invention, the term "polyester resin" means polyester resin other than PTT".

The toothbrush bristle obtained by mixing the two resins and spinning the mixture thereof is rapidly dissolved due to its low melting point. Accordingly, a needle-shaped bristle, having a taper length of 6 mm or less, preferably 5 mm or less, and more preferably 4 mm, can be obtained. Further, tapering time can be also decreased concomitantly.

It is preferred that the mixing ratio of polyester resin to PTT resin be in the range of 90~40 to 10~60. When the content of PTT is below this range, taper length and dissolution time are excessively increased. Further, when the content of PTT is above this range, dissolution time is also increased, and production cost is excessively increased because the PTT is relatively expensive.

The toothbrush bristle obtained by mixing the two resins can be formed into a needle-shaped bristle having a taper length of 6 mm or less through various methods.

It is most preferred that the needle-shaped bristle be manufactured by applying the prior method of the present inventor.

That is, needle-shaped bristles having a taper length of 6 mm or less can be manufactured by the steps of preparing a bundle of toothbrush bristles by mixing a polyester resin (a polyester resin other than a PTT resin) and a PTT resin in a ratio of 90~40 to 10~60 and spinning the mixture thereof, preliminarily immersing the bundle of toothbrush bristles into a liquid material, and immersing the bundle of toothbrush bristles into a chemical at random.

Further, a needle-shaped bristle, one end of which is tapered, can be manufactured by layering two bundles of toothbrush bristles, sealing the layered portion using a tape and immersing the sealed bundles of toothbrush bristles into a chemical. A sharp edge of a non-needle shaped portion of the needle shaped bristle, one end of which is tapered, can be gently rounded by forming small needle holes in the sealing tape.

Moreover, even though the bundle of toothbrush bristles preliminarily immersed into the liquid material, as in the conventional technology, is vertically immersed into a chemical, needle-shaped bristles having a taper length of 6 mm or less can be manufactured. Here, needle-shaped bristles having a taper length of 6 mm or less are manufactured at a success rate of 99% or more.

Further, needle-shaped bristles having a taper length of 6 mm or less can be manufactured by increasing the concentration and temperature of a chemical. Further, the needle-shaped bristle having a taper length of 6 mm or less can be also manufactured by adding ammonium sulfate, which is a decomposition promoter, to a chemical solution. Through these methods, the needle-shaped bristles having a taper length of 6 mm or less are manufactured at a success rate of 80% or more. When the needle-shaped bristles are used in an anchorless type toothbrush, which requires bristles that are needle-shaped at one end, needle shaped bristles having greater taper lengths than desired taper lengths are removed, and then remaining needle-shaped bristles are used.

In the anchorless type toothbrush, which requires bristles that are needle-shaped at one end, as described above, a needle-shaped bristle having a short taper length is more advantageous. However, when the taper length of the needle-shaped bristle is excessively short, the needle-shaped bristle loses its characteristic softness. Accordingly, it is preferred that the taper length be 2 mm or more, and preferably 2.5 mm or more.

MODE FOR INVENTION

Examples of the Present Invention are as Follows

Example 1

Figure 2:
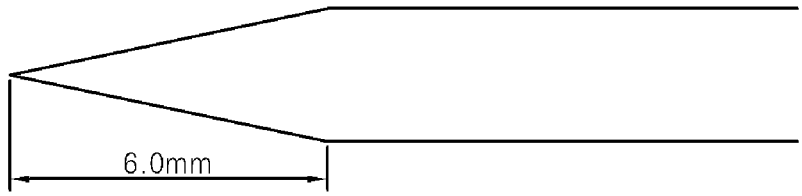
FIG. 2 is a side elevation view showing a needle-shaped bristle according to the present invention.

80% by weight of PBT (B-6550 manufactured by BASF Company Ltd. of Germany) was mixed with 20% by weight of PTT (Sorora Bright™) manufactured by Dupont Company Ltd. of the United States), and then the mixture thereof was spun using a conventional spinning method, thereby manufacturing a bundle of toothbrush bristles having a diameter of 8 mils. Next, the manufactured bundle of toothbrush bristles was cut to a length of 25 mm and then the cut bundle of toothbrush bristles was preliminarily immersed into an ethanol solution having a concentration of 20%. Then, the preliminarily immersed bundle of toothbrush bristles was entirely immersed into a sodium hydroxide solution having a concentration of 30% and a temperature of 130, and both ends of the bundle of toothbrush bristles were dissolved for 35 minutes, and then the dissolved bundle of toothbrush bristles was neutralized using a weak acid, cleaned in water and dried, thereby obtaining a needle-shaped bristle having a tip diameter of 0.01~0.02 mm and a taper length of 2.5~4.0 mm (refer to FIG. 2).

Example 2

The needle-shaped bristle manufacturing process was performed as in Example 1, except that the liquid used in the preliminary immersion process was replaced with cool water.

The obtained needle-shaped bristle, as in Example 1, had a tip thickness of 0.01~0.02 mm, but had a taper length of 3.5~4.0 mm.

Example 3

The needle-shaped bristle manufacturing process was performed as in Example 1, except that the liquid used in the preliminary immersion process was replaced with a surfactant solution having a concentration of 2%.

The obtained needle-shaped bristle, as in Example 1, had a tip thickness of 0.01~0.02 mm, but had a taper length of 2.0~4.0 mm.

Comparative Example 1

The needle-shaped bristle manufacturing process was performed as in Example 1, except that the toothbrush bristle used in the tapering process was replaced with a PBT 520(™) bundle having a diameter of 8 mils manufactured by Toray Industries Inc.

The obtained needle-shaped bristle, as in Example 1, had a tip thickness of 0.01~0.02 mm, but had a taper length of 6.0~8.0 mm.

Comparative Example 2

The needle-shaped bristle manufacturing process was performed as in Example 1, except that the mixing ratio of PBT to PTT was changed to 95 to 5.

The obtained needle-shaped bristle, as in Example 1, had a tip thickness of 0.01~0.02 mm, but had a taper length uniformly distributed from 5.0~8.0 mm.

Comparative Example 3

The needle-shaped bristle manufacturing process was performed as in Example 1, except that the mixing ratio of PBT to PTT was changed to 36 to 65.

The obtained needle-shaped bristle, as described in Example 1, had a tip thickness of 0.01~0.02 mm, but had a taper length uniformly distributed from 5.0~8.0 mm.

Example 4

The needle-shaped bristle manufacturing process was performed as in Example 1, except that a bundle of toothbrush bristles used in Example 1 was cut to a length of 20.5 mm, the two cut bundles of toothbrush bristles were attached to each other, and then the attached portion was taped using a heat resistant masking tape having a width of 20 mm to prevent a chemical from infiltrating thereinto.

The obtained needle-shaped bristle had a tip diameter of 0.01~0.02 mm and a taper length of 2.5~4.0 mm, and only one end thereof was tapered.

Example 5

Figure 3:
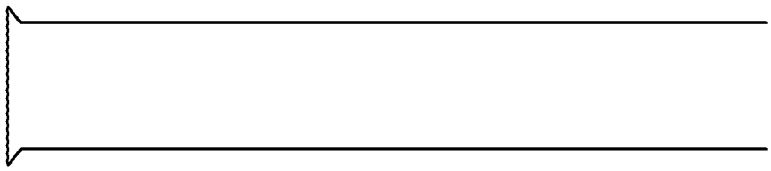
FIG. 3 shows a schematic view of a cut toothbrush bristle.
Figure 4:
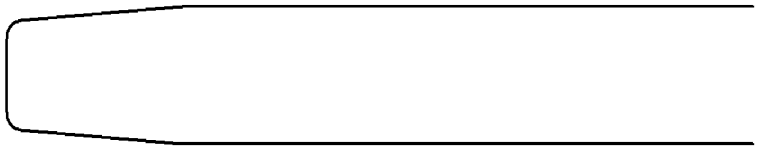
FIG. 4 shows a schematic view of a partially dissolved toothbrush bristle.

The needle-shaped bristle manufacturing process was performed as in Example 4, except that five holes were formed around the heat resistant masking tape using a needle to allow a small amount of chemical to infiltrate thereinto. As a result, one end of the obtained toothbrush bristle was tapered as in Example 4 and the other end thereof, which was not tapered, was slightly dissolved, so that an sharp section formed at the time of the cutting process was removed, thereby preventing damage to the gums (refer to FIG. 3).

Example 6

The needle-shaped bristle manufacturing process was performed as in Example 5, except that the two bundles of toothbrush bristles were fixed using a rubber band without sealing the attached portion using tape. The obtained toothbrush bristles were similar to the toothbrush bristles obtained in Example 5, but the portion which was not tapered was dissolved more.

Example 7

80% by weight of PBT (B-6550 manufactured by BASF Company Ltd. in Germany) was mixed with 20% by weight of PTT (Sorora Bright™) manufactured by Dupont Company Ltd. of the United States), and then the mixture thereof was spun using a conventional spinning method, thereby manufacturing a bundle of toothbrush bristles having a diameter of 7 mils. Next, the manufactured bundle of toothbrush bristles was cut to a length of 30.8 mm, and then the cut bundle of toothbrush bristles was entirely immersed into a sodium hydroxide solution having a concentration of 45% and a temperature of 140° without performing a preliminary immersion process, and both ends of the bundle of toothbrush bristles were dissolved for 35 minutes, and then the dissolved bundle of toothbrush bristles was neutralized using a weak acid, cleaned in water and dried, thereby obtaining a needle-shaped bristle having a tip diameter of 0.01~0.04 mm and a taper length of 2.5~7.0 mm. However, in the obtained needle-shaped bristle, a portion having a taper length of 6.0 mm or more accounted for only 5%, a portion having a taper length of 5.0 mm or more accounted for only 8%, and a portion having a taper length of 4.0 mm or more accounted for only 11%.

Example 8

The needle-shaped bristle manufacturing process was performed as in Example 1, except that 0.3% by weight of quaternary ammonium salt (Cetyltrimethylammonium bromide), which is a decomposition promoter, was added to the solution, and was then dissolved for 20 minutes.

The obtained needle-shaped bristle has a tip thickness of 0.01~0.04 mm and a taper length of 2.5~8 mm. However, in the obtained needle-shaped bristle, a portion having a taper length of 6.0 mm or more accounted for only 7%, a portion having a taper length of 5.0 mm or more accounted for only 9%, and a portion having a taper length of 4.0 mm or more accounted for only 12%.

Comparative Example 4

The needle-shaped bristle manufacturing process was performed as in Example 1, except that the preliminary immersion process was not performed.

The obtained needle-shaped bristles had a tip thickness of 0.01~0.04 mm and a taper length of 6.0~12 mm. As described above, the obtained needle-shaped bristles were widely formed throughout the above range. In particular, the obtained needle-shaped bristles were unsuitable for use in the manufacture of a toothbrush.

We claim:

1. A method of forming toothbrush bristles, the method comprising:

preparing bundles of the toothbrush bristles by mixing a polyester resin and a PTT resin in a ratio of 90~40 to 10~60;

cutting the bundles of the toothbrush bristles;

layering a pair of cut bundles of the toothbrush bristles of the cut bundles;

sealing the layered pair of cut bundles with tape;

preliminarily immersing the sealed bundles into a liquid not having the ability to dissolve the bristles; and tapering one side of the toothbrush bristles solely by entirely immersing the prepared bundles of toothbrush bristles into a chemical such that 80% or more of the toothbrush bristles have a length of taper of 4.0 millimeters or less, the length of taper having a smooth exterior surface, said tape having holes therein so as to allow the chemical to infiltrate into the layered pair so as to dissolve sharp edges of the cut bundles.

2. The method of claim 1, the tapering of the toothbrush bristles being only by the step of entirely immersing the prepared bristles into the chemical.

* * * * *